United States Patent [19]

Nagayama et al.

[11] Patent Number: 4,547,059

[45] Date of Patent: Oct. 15, 1985

[54] IMAGE-TRANSFER-TYPE ELECTROSTATIC RECORDING APPARATUS

[75] Inventors: Haruhiko Nagayama, Machida; Satoru Tomita, Kawasaki, both of Japan

[73] Assignee: Ricoh Company, Ltd., Tokyo, Japan

[21] Appl. No.: 436,796

[22] Filed: Oct. 26, 1982

[30] Foreign Application Priority Data

Oct. 28, 1981 [JP] Japan ..... 56-161706[U]
Dec. 4, 1981 [JP] Japan ..... 56-194484

[51] Int. Cl.[4] ..... G03G 15/00; G03G 15/14; G03G 21/00

[52] U.S. Cl. ..... 355/3 BE; 198/806; 355/3 TR

[58] Field of Search ..... 355/3 R, 3 TR, 3 BE, 355/16; 198/806, 807, 808

[56] References Cited

U.S. PATENT DOCUMENTS 4,344,693 8/1982 Hamaker ..... 355/3 BE
4,403,851 9/1983 Yanagawa ..... 355/3 BE X

FOREIGN PATENT DOCUMENTS 113174 9/1981 Japan ..... 355/3 TR

*Primary Examiner*—Fred L. Braun
*Attorney, Agent, or Firm*—Oblon, Fisher, Spivak, McClelland & Maier

[57] ABSTRACT

An image-transfer-type electrostatic recording apparatus in which an endless-belt-shaped latent-electrostatic-image-bearing recording medium is trained over a drive roller and a driven roller so as to be rotatable therearound. The rollers are supported by a frame member. The latent electrostatic images are developed to visible images during the rotation of the latent-electrostatic-image-bearing recording medium, and the developed visible images are then transferred to a recording sheet. A device corrects the skewing of the endless-belt-shaped recording medium by moving upwards or downwards one end portion of the driven roller. A recording sheet guide member guides the recording sheet to a predetermined image transfer section on the surface of the developed visible image bearing recording medium. The recording sheet guide member is substantially integral with the frame member and/or the driven roller, thereby guaranteeing appropriate contact of the recording sheet with the recording medium regardless of the movement of the driven roller for correcting the skewing of the endless-belt-shaped recording medium.

10 Claims, 15 Drawing Figures

IMAGE-TRANSFER-TYPE ELECTROSTATIC RECORDING APPARATUS

BACKGROUND OF THE INVENTION

The present invention relates to an improved image-transfer-type electrostatic recording apparatus in which an endless-belt-shaped latent-electrostatic-image-bearing recording medium is trained over a drive roller and a driven roller which are supported by a frame member, and is rotated, and the latent electrostatic images are developed to visible images during the rotation of the latent-electrostatic-image-bearing recording medium, and the developed visible images are then transferred to a recording sheet, and there is disposed a device for correcting the skewing of the endless-belt-shaped recording medium by moving upwards or downwards one end portion of the driven roller. More particularly the present invention relates to an electrostatic recording apparatus of the above-described type, comprising a recording sheet guide means which is substantially integral with the above-mentioned frame member and/or driven roller, thereby guaranteeing appropriate contact of the recording sheet with the recording medium.

In an image-transfer-type recording apparatus, such as electrophotographic copying apparatus, electrophotographic offset master making apparatus, electrophotographic printing apparatus or facsimile apparatus, as a latent-electrostatic- image-bearing recording medium, an endless-belt-shaped photoconductor or dielectric material is employed as well as a drum-shaped photoconductor. In the case of the endless-belt-shaped photoconductor or dielectric material, if one peripheral length is slightly different from the other, or if the diameter of one end portion of a drive roller or driven roller for rotating the endless-belt-shaped photoconductor or dielectric material is slightly different from the diameter of the other end portion of the drive roller or driven roller, the endless belt is gradually skewed as it is driven in rotation by the drive roller. As a result, the endless-belt-shaped photoconductor may be damaged in the edge portions, and normal latent electrostatic image formation or image transfer may be interfered with, particularly in the side areas of the photoconductor.

For avoidance of such shortcomings, conventionally one end portion of a driven roller is slightly moved horizon-tally or vertically relative to the drive roller to counter the skewing of the endless-belt-shaped photoconductor during the rotation thereof.

Referring to FIG. 1, there is shown a schematic partial view of a conventional electrostatic recording apparatus which permits vertical positional adjustment of a driven roller 2 relative to a drive roller 1 through a frame member which supports the drive roller 1 and the driven roller 2, in order to counter the skewing of an endless-belt-shaped photoconductor 3.

In the electrostatic image recording apparatus shown in FIG. 1, if one end portion of the driven roller 2 is moved upwards or downwards for countering the skewing of the endless-belt-shaped latent-electrostatic-image-bearing photoconductor 3, not only the distance between the photoconductor 3 and an image transfer charger 4, but also the distance between the photoconductor 3 and a recording sheet guide member 5, is changed, since the recording sheet guide member 5 is integral with the image transfer charger 4. As a result, a recording sheet 8, when transported, deviates from its predetermined transportation path. In particular, when the recording sheet guide member 5 is moved beyond a certain range away from the photoconductor 3, the recording sheet 8 cannot be brought into close contact with the photoconductor 3 in a predetermined image transfer section thereof as illustrated in FIG. 2. As a result, for instance, blurred images are formed at a side portion of the recording sheet 8, or no images are formed thereon.

Such problems could be solved if the image transfer charger 4 were designed so as to be integral with the recording sheet guide 5, and also to be movable together with the photoconductor 3 when the driven roller 2 is moved upwards or downwards in order to counter the skewing of the photoconductor 3.

However, the image transfer charger 4 is usually fixed to a guide rail member 7 through a spring plate 6 or the like as shown in FIG. 1. Therefore, it would be impractical to move the image transfer charger 4 against the resilience of the spring plate 6 or the like. It would also be impractical to move the image transfer charger 4 together with the guide rail member 7, since a very complicated mechanism would be necessary for attaining such movement of the image transfer charger 4.

Furthermore, in the above-described conventional electrostatic image recording apparatus, since the recording sheet guide 5 is disposed separately from the previously mentioned frame member for supporting the drive roller 1 and the driven roller 2, and from the driven roller 2 as shown in FIGS. 1 and 2, it is extremely difficult to dispose (i) the recording sheet guide 5 and (ii) the photoconductor unit comprising the drive roller 1, and driven roller 2 and the frame member with the endless-belt-shaped photoconductor 3 trained over the two rollers 1 and 2, with a predetermined space accurately maintained between the recording sheet guide 5 and the photoconductor unit, particularly in the manufacturing process.

SUMMARY OF THE INVENTION

It is therefore an object of the present invention to provide an improved image-transfer-type electrostatic recording apparatus in which latent electrostatic images are formed on an endless-belt-shaped recording medium, developed to visible images and then transferred to a recording sheet, which electrostatic recording apparatus is improved so as to be capable of guiding a recording sheet towards the latent-electrostatic-image-bearing recording medium with a predetermined gap therebetween and then bringing the recording sheet into appropriate contact with the latent-electrostatic-image-bearing recording medium, notwithstanding skewing of the latent-electrostatic-image-bearing recording medium and the movements which are caused to take place for the correction thereof.

According to the present invention, this object is attained by an electrostatic recording apparatus of the above-described image-transfer-type in which an endless-belt-shaped recording medium is trained over a drive roller and a driven roller supported by a frame member and is rotated, and the latent electrostatic images formed on the endless-belt-shaped recording medium are developed to visible images during the rotation of the recording medium, and the developed visible images are then transferred to a recording sheet, and there are disposed (i) a device for correcting the skewing of the endless-belt-shaped recording medium by moving upwards or downwards one end portion of the driven roller, and (ii) a recording sheet guide means which is substantially integral with the above-mentioned frame member and/or the driven roller, thereby guaranteeing appropriate contact of the recording sheet with the endless-belt-shaped recording medium, regardless of the movement of the driven roller for correcting the skewing of the recording medium.

BRIEF DESCRIPTION OF THE DRAWINGS

In the drawings,

FIG. 10(*b*) is a section taken on line X—X in FIG. 10(*a*).

FIG. 11(*b*) is an illustration in explanation of the operation of the recording sheet guide member shown in Fig. 9, in which one end portion of the driven roller shown in FIG. 11(*a*) is moved downwards for correcting the skewing of the endless-belt-shaped photoconductor.

DETAILED DESCRIPTION OF THE PREFERRED EMBODIMENTS

Figure 1:
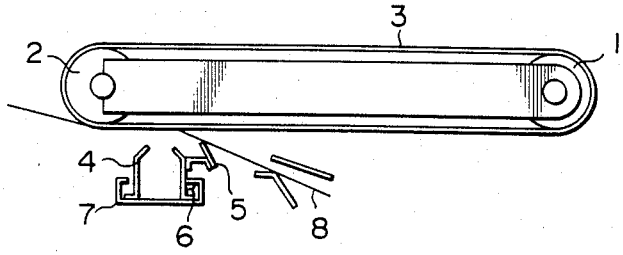
FIG. 1 PRIOR ART
FIG. 1. is a schematic illustration of a conventional image-transfer-type electrostatic recording apparatus capable of countering the skewing of an endless-belt-shaped photoconductor, in explanation of transportation of a recording sheet through an image transfer section.
Figure 2:
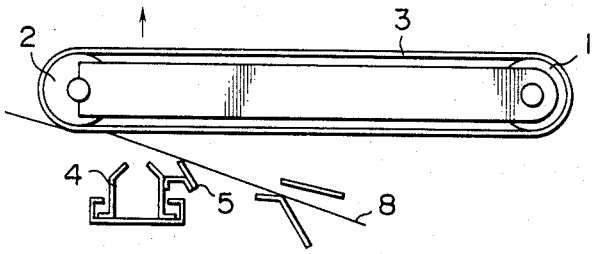
FIG. 2 PRIOR ART
FIG. 2 is a schematic illustration of the conventional image-transfer-type electrostatic recording apparatus shown in FIG. 1, in explanation of the transportation path of a recording sheet when the driven roller of the apparatus is moved upwards for countering the skewing of the endless-belt-shaped photoconductor.
Figure 3:
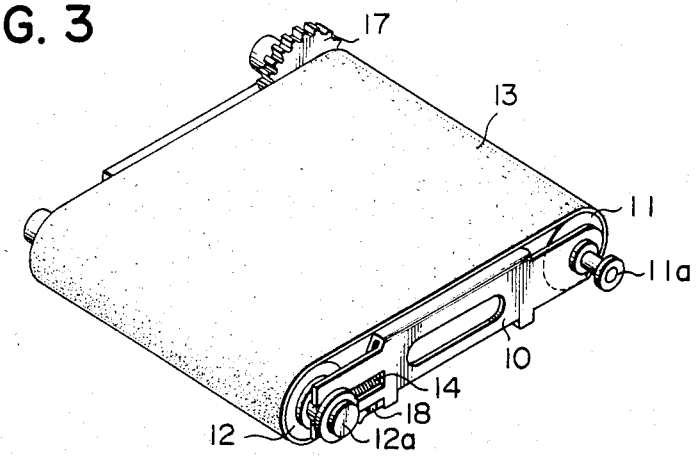
FIG. 3 is a schematic perspective view of a photoconductor unit for use in an embodiment of an image-transfer-type electrostatic recording apparatus according to the present invention.

Referring to FIG. 3, there is perspectively shown a photoconductor unit for use in an embodiment of an image-transfer-type electrostatic recording apparatus according to the present invention.

As shown in the figure, the photoconductor unit comprises a drive roller 11, a driven roller 12 and a pair of frame members 10 (only the front frame member is shown) for rotatably supporting the drive roller 11 and the driven roller 12. As shown in FIG. 3, one end portion of the front frame member 10 near the driven roller 12 is divided into two portions. In the cut-away portion between the two-divided portions, the shaft of the driven roller 12 is held in such a manner that one side of the driven roller 12 is vertically movable, while the other side of the driven roller 12 is fixed. An endless-belt-shaped photoconductor 13 is trained over the drive roller 11 and the driven roller 12 as shown in the figure.

One end of a depressed spring 14 is connected to the frame member 10, and the other end of the spring 14 urges the driven roller 12 in such a direction as to apply appropriate tension to the photoconductor 13 which is trained over the drive roller 11 and the driven roller 12. Another spring 14 (not shown) is attached to the other frame member 10 (not shown) and urges the driven roller 12 in the same manner as described above.

Figure 4:
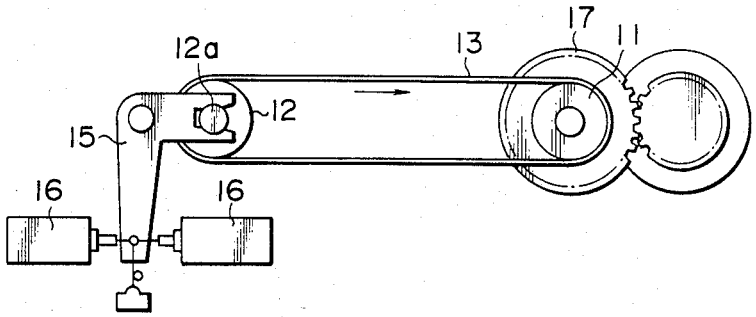
FIG. 4,is a schematic illustration in explanation of a skew adjustment mechanism of the embodiment of an image transfer type recording apparatus partially shown in FIG. 3.

Referring to FIG. 4, reference numeral 15 indicates a skew-adjustment arm in the shape of a bell crank for correcting the skewing of the endless-belt-shaped photoconductor 13 trained over the drive roller 11 and the driven roller 12. One of a pair of bearings of the driven roller 12, for instance, the front bearing 12*a*, engages a forked portion of the skew-adjustment arm 15, so that the driven roller 12 is held by the forked portion of the skew-adjustment arm 15, while the other bearing (not shown) is fixed. The other end portion of the skew-adjustment arm 15 is connected to a pair of solenoids 16, whereby the front end of the driven roller 12 can be moved upwards or downwards within the range of the previously described cut-away portion of the frame member 10, with the back end of the driven roller 12 fixed, whereby the skewing, if any, of the photoconductor 13 can be corrected. Reference numeral 17 indicates a drive transmission gear for driving the drive roller 11 in rotation.

Figure 5:
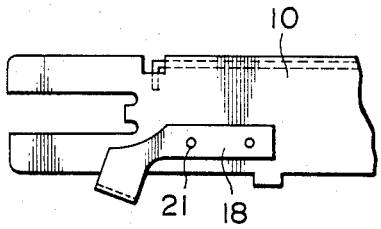
FIG. 5 is a partially enlarged view of a frame for supporting a drive roller and a driven roller over which an endless-belt-shaped photoconductor is trained, and a recording sheet guide member attached to the frame for the embodiment of an image transfer type recording apparatus which is partially shown in FIG. 3.
Figure 6:
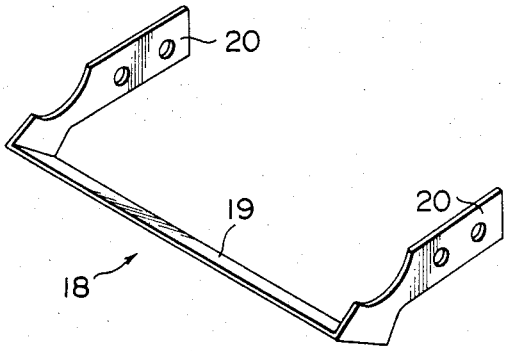
FIG. 6 is a schematic perspective view of the recording sheet guide member shown in FIG. 5.

Referring to FIGS. 5 and 6, there is schematically shown a recording sheet guide member 18 comprising a guide portion 19 and a pair of arm portions 20 extending from the opposite ends of the guide portion 19. The guide portion 19 of the recording sheet guide member 18 is inclined, at a certain distance from the driven roller 12, so as to bring the recording sheet into contact with the surface of the photoconductor 13 as the recording sheet is transported. The recording sheet guide member 18 is attached to a lower portion of the pair of frame members 10 through the pair of arm portions 20 and screws 21 in such a manner that the recording sheet guide member 18 bridges the pair of frame members 10, crossing over the endless-belt-shaped photoconductor 13, with a certain gap therebetween, whereby a recording sheet transported towards an image transfer section is guided so as to be brought into contact with the surface of the endless-belt-shaped photoconductor 13.

In this embodiment of an image transfer type electrostatic recording apparatus according to the present invention, since the recording sheet guide member 18 is fixed to the pair of frame members 10, the recording sheet guide member 18 is situated accurately at a predetermined distance from the photoconductor unit.

Although the driven roller 12 is moved upwards or downwards for correcting the skewing of the endless-belt-shaped photoconductor 13, the movable range of the driven roller 12 is within the vertical range of the cut-away portion of the frame member 10, and, in practice, in the range of approximately 0.5 mm to 1.00 mm. Therefore, the recording sheet guide member 18 is substantially integral with the driven roller 12. Therefore, even if the driven roller 12 is located at any adjusted position within the above-described range, the position of the recording sheet guide member 18 relative to the driven roller 12 does not substantially vary. Thus, the recording sheet can be correctly transported to a predetermined image transfer section on the endless-belt-shaped photoconductor 13.

Figure 7:
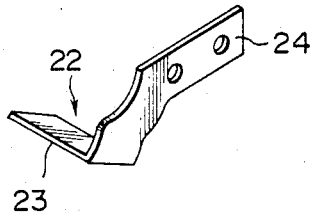
FIG. 7 is a schematic perspective view of another recording sheet guide member which can be employed in the present invention.

Referring to FIG. 7, there is shown a perspective view of another recording sheet guide member 22 for use in the present invention, which comprises a guide portion 23 and an arm portion 24 extending at a right angle from one end of the guide portion 23. The guide portion 23 is designed so as to extend over only a side portion of the photoconductor 13 as illustrated in FIG. 7. The recording sheet guide member 22 is fixed through the arm portion 24 to the frame member 10. A counterpart recording sheet guide member 22 (not shown) is also fixed to the other frame member 10 (not shown). Thus, a recording sheet transported towards the endless-belt-shaped photoconductor 13 is guided by the recording sheet guide member 22 and the other counterpart guide member 22 (not shown) situated on the opposite side.

As compared with the previously described guide member 18, the recording sheet guide member 22 can be easily detached from the frame member 10 and is convenient when the endless-belt-shaped photoconductor 13 is exchanged.

Figure 8:
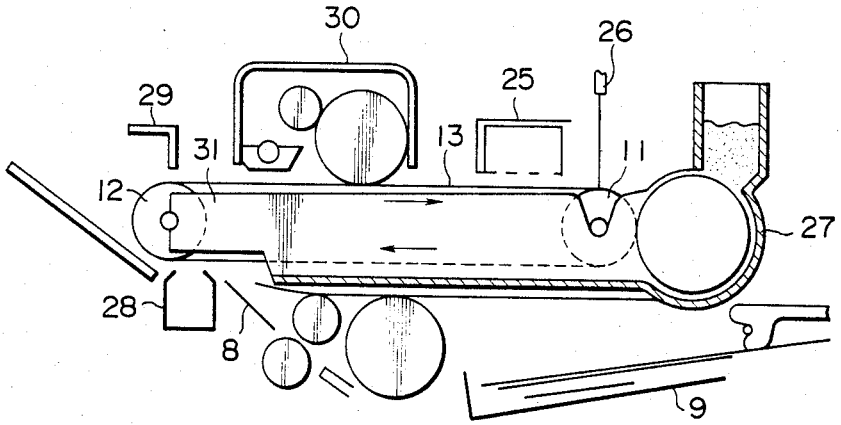
FIG. 8 is a schematic view of another embodiment of an image-transfer-type recording apparatus according to the present invention.

Referring to FIG. 8, there is shown a schematic view of another embodiment of an image-transfer-type recording apparatus according to the present invention.

In the figure, the endless-belt-shaped photoconductor 13 is trained over the drive roller 11 and the driven roller 12 and is rotated around the two rollers 11 and 12. Reference numeral 25 indicates a corona charger for applying electric charges uniformly on the surface of the endless-belt-shaped photo-conductor 13. Reference numeral 26 indicates an exposure apparatus for projecting optical images of an original to the uniformly charged photoconductor 13 to form latent electrostatic images corresponding to the optical images of the original. Reference numeral 27 indicates a development apparatus for developing the latent electrostatic images formed on the surface of the photoconductor 13 to visible images by depositing toner thereon. Reference numeral 28 indicates an image transfer charger for transferring the developed visible images from the photoconductor 13 to a recording sheet 8 supplied from a recording sheet cassette 9. After image transfer, the recording sheet 8 is transported to an image fixing apparatus (not shown) and is then discharged from the recording apparatus. In the meantime, the endless-belt-shaped photoconductor 13 is moved under a quenching charger 29 by which the residual charges on the surface of the photoconductor 13 are quenched. Residual toner on the photoconductor 13 is eliminated therefrom by a cleaning apparatus 30. Reference numeral 31 indicates a frame member for supporting the drive roller 11 and the driven roller 12.

The image transfer type recording apparatus shown in FIG. 8 is provided with a skew correction apparatus (not shown) for correcting the skewing of the the endless-belt-shaped photoconductor 13 which may occur during the rotation of the photoconductor 13. More specifically, the skew correction apparatus optically detects the skewing of the photoconductor 13, and, when the skewing exceeds a certain limit, one end portion of the driven roller 12 is moved upwards or downwards, whereby the skewing of the endless-belt-shaped photoconductor 13 is corrected.

Figure 9:
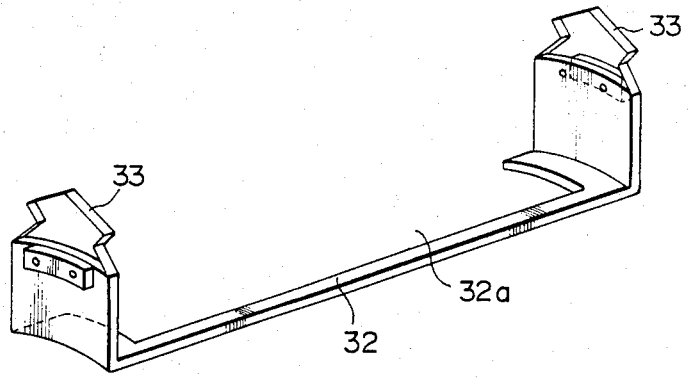
FIG. 9 is a schematic perspective view of a recording sheet guide member for the embodiment of an image-transfer-type recording apparatus shown in FIG. 8.

Referring to FIG. 9, there is shown a schematic perspective view of a recording sheet guide member 32 for the image-transfer-type recording apparatus shown in FIG. 8. The recording sheet guide member 32 comprises (i) a guide portion with a cut-away portion 32*a* for allowing application of corona charges from the image transfer charger 28 disposed under the recording sheet guide member 32 to the surface of a recording sheet which passes over the guide portion, (ii) a pair of arm portions extending at right angles from the opposite ends of the guide portion and (iii) a pair of clip members 33 disposed on the tops of the pair of arm portions as shown in FIG. 9. Each clip member is made of a spring wire or plate, with a pair of V-shaped clipping portions in which the bearing 12*a* of the driven roller and a pin 34 (shown in FIGS. 10(*a*) and 10(*b*) secured to the frame member 31 are caused to tightly fit due to the resilience of the clip members 33.

Figure 10A:
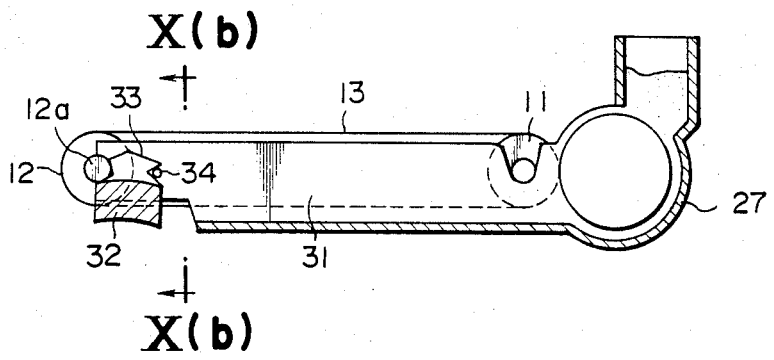
FIG. 10(*a*) is a schematic illustration showing the attachment of the recording sheet guide member (shown in FIG. 9) to the embodiment of an image transfer type recording apparatus according to the present invention shown in FIG. 8.
Figure 10B:
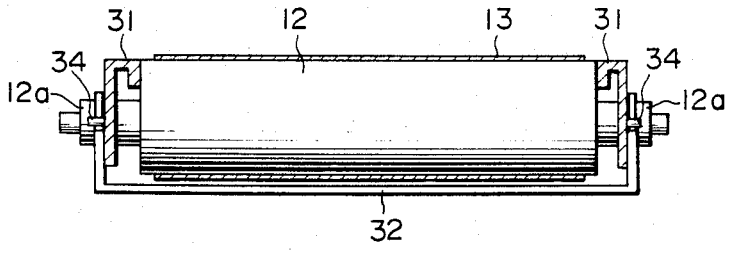

Referring to FIG. 10(*a*), there is schematically shown the above-described attachment of the recording sheet guide member 32. FIG. 10(*b*) is a section taken on line X—X in FIG. 10(*a*).

Figure 11A:
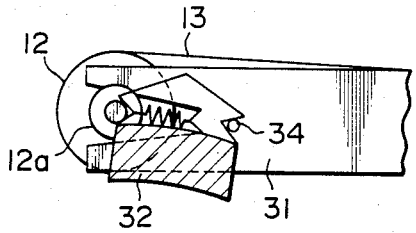
FIG. 11(*a*) is an illustration in explanation of the operation of the recording sheet guide member shown in FIG. 9, in which one end portion of a driven roller is moved upwards for correcting the skewing of an endless-belt-shaped photoconductor.
Figure 11B:
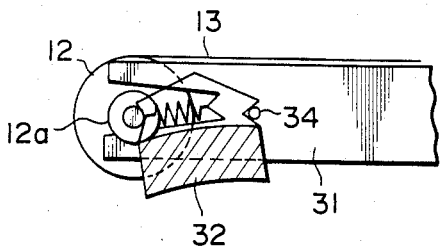

When one end portion of the bearing 12*a* of the driven roller 12 is moved upwards as shown in FIG. 11(*a*) or downwards as shown in FIG. 11(*b*), in order to correct the skewing of the endless-belt-shaped photoconductor 13, the recording sheet guide member 32 is turned clockwise or counterclockwise about the pin 34, respectively, with the gap between the peripheral surface of the driven roller 12 and the guide portion of the recording sheet guide member 32 accurately maintained. In other words, the recording sheet can be accurately guided by the recording sheet guide member 32 to a predetermined image transfer section on the endless-belt-type photoconductor 13 passing around the driven roller 12.

As compared with the first described embodiment of an image-transfer-type electrostatic recording apparatus according to the present invention, which is schematically shown in FIGS. 3 through 6, the just described embodiment can attain a more accurate guiding of the recording sheet to the predetermined image transfer section on the photoconductor 13, since the gap between the surface of the photoconductor 13 and the leading edge of the recording sheet at the guide portion of the recording sheet guide member 32 is maintained with constant accuracy, regardless of the adjusted position of the driven roller 12.

As a matter of course, it is not necessary that the recording sheet guide member 32 be made in one piece, but it can be separated at the guide portion into two, as in the case of the recording sheet guide member 22 shown in FIG. 7.

Since the recording sheet guide member 32 is attached by the resilient clip member 33 to the bearing 12*a* of the driven roller 12 and to the pin 34 secured to the frame member 31, the guide member 32 can be easily detached when the endless-belt-shaped photoconductor 13 is exchanged or when necessary maintenance operations are performed. When the guide member 32 is separated in two pieces, the detachment is much easier.

Figure 12:
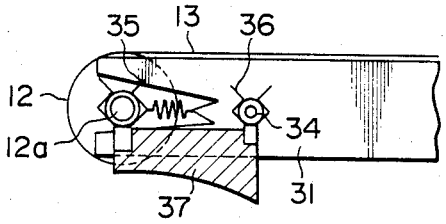
FIG. 12 is a schematic illustration showing the attachment of another recording sheet guide member to the embodiment of an image-transfer-type recording apparatus shown in FIG. 8.

Referring to FIG. 12, there is schematically shown another recording sheet guide member 37 for use in the embodiment of an image-transfer-type recording apparatus according to the present invention shown in FIG. 8.

As shown in the figure, two resilient clip members 35 and 36 are secured to the recording sheet guide member 37 instead of the resilient clip member 33. The bearing 12*a* of the driven roller 12 fits the resilient clip member 35, and the pin 34 secured to the frame member 31 fits the resilient clip member 36.

The recording sheet guide member 37 can be either in the same form as that of the recording sheet guide member 32 or in the form of two separate pieces similar to the recording sheet guide member 22 as shown in FIG. 7. When the recording sheet guide member 37 is in the form of two separate pieces, they can be attached to the frame member 31 and to the bearing 12*a* of the driven roller 12 as shown in FIG. 13.

Figure 13:
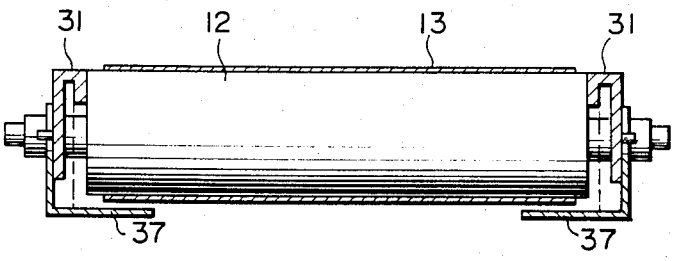
FIG. 13 is a schematic illustration showing the attachment of a further recording sheet guide member to the embodiment of an image-transfer-type recording apparatus shown in FIG. 8.

In the case of the recording sheet guide member 37 as shown in FIG. 13, the recording sheet guide member 37 does not cross over the endless-belt-shaped photoconductor 13, but each piece of the recording sheet guide member 37 is disposed on opposite sides of the photoconductor 13. In this case, it is extremely easy to detach those pieces of the recording sheet guide member 37. For more secure attachment of each piece of the recording sheet guide member 37, each piece can be attached in such a manner that the frame member 31 is sandwiched between the two pieces of the recording sheet guide member 37 and an inside member indicated by broken lines, as shown in FIG. 13.

What is claimed is:

1. In an image-transfer-type electrostatic recording apparatus in which an endless-belt-shaped recording medium capable of forming latent electrostatic images thereon is trained over a drive roller and a driven roller so as to be rotatable therearound for developing the latent electrostatic images to visible images and transferring the developed visible images to a recording sheet; said drive and driven rollers being supported by a frame member; and comprising a device for correcting the skewing of said endless-belt-shaped recording medium by vertically moving one end portion of said driven roller, the improvement wherein one end portion of said driven roller is supported by said frame member at one end portion thereof so as to be movable within a predetermined range for correcting the skewing of said recording medium, and there is disposed a recording sheet guide means comprising a sheet guide member along which said recording sheet is guided onto a predetermined image transfer section on the surface of said recording medium, which sheet guide member is supported by said frame member, said sheet guide member moving in response to vertical movement of said driven roller.

2. An image-transfer-type electrostatic recording apparatus as claimed in claim 1, wherein said recording sheet guide member extends across the width of said recording medium.

3. An image-transfer-type electrostatic recording apparatus as claimed in claim 1, wherein said recording sheet guide member comprises two submembers, each submember extending over each side portion of said recording medium, along which submembers said recording sheet is guided.

4. In an image-transfer-type electrostatic recording apparatus in which an endless-belt-shaped recording medium capable of forming latent electrostatic images thereon is trained over a drive roller and a driven roller so as to be rotatable therearound for developing the latent electrostatic images to visible images and transferring the developed visible images to a recording sheet; said drive and driven rollers being supported by a frame member; and comprising a device for correcting the skewing of said endless-belt-shaped recording medium by vertically moving one end portion of said driven roller, the improvement wherein one end portion of said driven roller is supported by said frame member at one end portion thereof so as to be movable within a predetermined range for correcting the skewing of said recording medium, and there is disposed a recording sheet guide means comprising a sheet guide member along which said recording sheet is guided onto a predetermined image transfer section on the surface of said recording medium, said recording sheet guide member being held between said one end portion of said frame member and said driven roller, said recording sheet guide member moving in response to vertical movement of said driven roller.

5. An image-transfer-type electrostatic recording apparatus as claimed in claim 4, wherein said recording sheet guide member extends across the width of said recording medium.

6. An image-transfer-type electrostatic recording apparatus as claimed in claim 4, wherein said recording sheet guide member comprises two submembers, each submember extending over each side portion of said recording medium.

7. An image-transfer-type electrostatic recording apparatus as claimed in claim 4, wherein said recording sheet guide member further includes an engagement member fixed thereto and is held by said frame member and by said driven roller through said engagement member, with one end portion of said engagement member engaging said driven roller and the other end portion of said engagement member engaging said portion of said frame member.

8. An image-transfer-type electrostatic recording apparatus as claimed in claim 4, wherein said recording guide sheet member further includes a pair of engagement members fixed thereto and is held by said frame member and by said driven roller through said pair of engagement members, with one engagement member engaging said driven roller and the other engagement member engaging said end portion of said frame member.

9. An image-transfer-type electrostatic recording apparatus comprising:

(a) a frame member;

(b) a drive roller supported by said frame member;

(c) a driven roller supported by said frame member;

(d) endless-belt-shaped latent electrostatic-image-bearing recording medium trained over said drive roller and said driven roller;

(e) skew correcting means for correcting the skewing of said endless-belt-shaped recording medium by moving one end portion of said driven roller upwards or downwards, said skew correcting means comprising means cuasing one end portion of said driven roller to move vertically relative to said frame member in response to a skewing of said endless-belt-shaped recording medium; and (f) a recording sheet guide member along which, during use of the apparatus, a recording sheet is guided to an image transfer section on the surface of said recording medium, said recording sheet guide member being mounted on said frame member, at least one end of said recording sheet guide member being pivotably held between a portion of said frame member and said one end portion of said driven roller so that said recording sheet guide member moves in response to vertical movement of said driven roller.

10. An image-transfer-type electrostatic recording apparatus comprising:

(a) a frame member;

(b) a drive roller supported by said frame member;

(c) a driven roller supported by said frame member, said driven roller being concentrically mounted on a shaft;

(d) a pin projecting from said frame member in parallel to said driven roller;

(e) an endless-belt-shaped latent-electrostatic-image-bearing recording medium trained over said drive roller and said driven roller;

(f) skew correcting means for correcting the skewing of said endless-belt-shaped recording medium by moving one end portion of said driven roller upwards or downwrads, said skew correcting means comprising means for moving one end portion of said driven roller relative to said frame member; and (g) a recording sheet guide member along which, during use of the apparatus, a recording sheet is guided to an image transfer section on the surface of said recording medium, said recording sheet guide member being mounted on said frame member, one end of said recording sheet guide member being pivotably held between said pin and said shaft so that said recording sheet guide member moves in response to vertical movement of said driven roller.

* * * * *